US005274535A

United States Patent [19]

Gonser

[11] Patent Number: 5,274,535

[45] Date of Patent: Dec. 28, 1993

[54] DENTAL OPERATING LIGHT WITH COLOR CORRECTION

[75] Inventor: Donald I. Gonser, Lancaster, Pa.

[73] Assignee: Den-tal-ez, Inc., Valley Forge, Pa.

[21] Appl. No.: 960,527

[22] Filed: Oct. 13, 1992

[51] Int. Cl.[5] ..... F21V 13/00

[52] U.S. Cl. ..... 362/268; 362/293; 362/804

[58] Field of Search ..... 362/33, 240, 250, 263, 362/268, 293, 419, 804

[56] References Cited

U.S. PATENT DOCUMENTS

| | | | |
|---|---|---|---|
| 4,608,622 | 8/1986 | Gonser | 362/32 |
| 5,093,769 | 3/1992 | Luntsford | 362/804 X |
| 5,199,785 | 4/1993 | Scholz | 362/804 X |

OTHER PUBLICATIONS

Weidner, R. T.; *Physics*; Allyn and Bacon, Inc., Boston (1985), p. 807.

Giancoli, D. C.; *Physic, Principles with Applications*; Prentice Hall, Inc., Englewood Cliffs, NJ (1980,1985) p. 591.

*Primary Examiner*—Stephen F. Husar

*Attorney, Agent, or Firm*—Howson and Howson

[57] ABSTRACT

A color-correcting optical delivery system for a dental or medical operatory light in which hue is eliminated. Chromatic aberrations are corrected by canceling the diffractions in the system due to the different wavelengths of the various colors in the projected light.

11 Claims, 2 Drawing Sheets

DENTAL OPERATING LIGHT WITH COLOR CORRECTION

BACKGROUND OF THE INVENTION

The present invention relates to lighting devices, and more particularly to improvements in optical delivery systems suitable for use in dental and medical operatory lights.

A dental and medical operatory light differs significantly from an ordinary light projector by its ability to provide cool and color-corrected uniform illumination approaching pure white light comparable to sunlight in the 5000° K to 6000° K color temperature region with a color rendering index of greater than 90, and over a sharply-defined target area. Color correction is especially necessary in dentistry for distinguishing the shades of color presented by natural teeth which must be color-matched with artificial teeth. Natural teeth present a problem of translucency where internal layers of a tooth such as the enamel and dentin, make matching the colors of a difficult and complex exercise. Color-corrected light helps the dentist make a more perfect match. Obtaining natural corrected color also helps the professional in diagnosing soft tissue diseases.

The operatory light generally comprises at least one optical delivery system of a high intensity light source and with reflectors, and still others include lenses and filters with optical aperture stops for producing a sharp beam of light at a correlated color temperature approximately between 5000° K and 6000° K. A more detailed explanation of the optical principles involved is discussed in U.S. Pat. No. 4,608,622 for "Multi-Function Light Source" by D. I. Gonser.

Ideally, the optical delivery system should faithfully reproduce all of the colors at the target area, but in practice a variety of aberrations occur which are attributable to the optical delivery system, particularly to the lenses. Several types of aberrations are spherical aberration, astigmatism and curvature of field, distortion, and lateral and longitudinal (axial) chromatism. In dental operatory lights, chromatic aberration is probably the most detrimental of these because it produces a visible spectrum with a hue projected on the illuminated target. Hue tends to interfere with the ability to see slight differences in shades of color, particularly on white or near white surfaces. Shade matching with the naked eye is much more accurate under white light.

The origin of hue is caused by variations in the index of refraction of the lenses with wavelength. The shorter the wave length, the less diffraction. For example, the refractive index is higher for blue light than for red. Consequently, the focal point of the blue component is closer to the lens than the red component resulting in a purple hue on the illuminated surface. So if white light is incident on a lens, the different colors are focused at different points and result in colored fringes or so-called hue on a target area. These color hues cause erroneous or imperceptible differences to the naked eye on nearly white surfaces.

Presently there does not exist a simple and economic color-correcting optical delivery system for use in the relatively confined space of a dental or medical operatory light which eliminates hue by cancellation of chromatic aberrations.

SUMMARY OF THE INVENTION

Accordingly, it is an object of the present invention to provide an improved color-correcting optical delivery system in a dental or medical operatory light, or the like, in which hue due to aberration in the optical delivery system is substantially eliminated.

Another object is to provide a lighting device in which color remains in tack in the projected light beam of light.

Still another object is to provide a dental or medical operatory light which will enable a user to visually distinguish with the naked eye slight differences in shades of color within illuminated target areas such as in the oral cavity or other anatomical surfaces.

A further object is to provide economical and simple optical delivery systems for correcting chromatic aberrations in a confined space of a dental or medical operatory light.

Briefly, these and other objects of the invention are achieved by an optical delivery system in a dental or medical operatory light by combining optical elements of opposite refraction indices for canceling chromatic aberrations. In a preferred embodiment, a meniscus wavelength correcting lens is added to the front of a single aspheric light condensing lens causing ray paths in a color-temperature light beam to intersect at the same focal point, and thereby provide a proper mix of colors for light of a desired color temperature and color rendering index.

BRIEF DESCRIPTION OF THE DRAWINGS

The foregoing and other objects, features and advantages of the present invention should become apparent from the following description when taken in conjunction with the accompanying drawings, wherein.

DESCRIPTION OF THE PREFERRED EMBODIMENT

Figure 1:
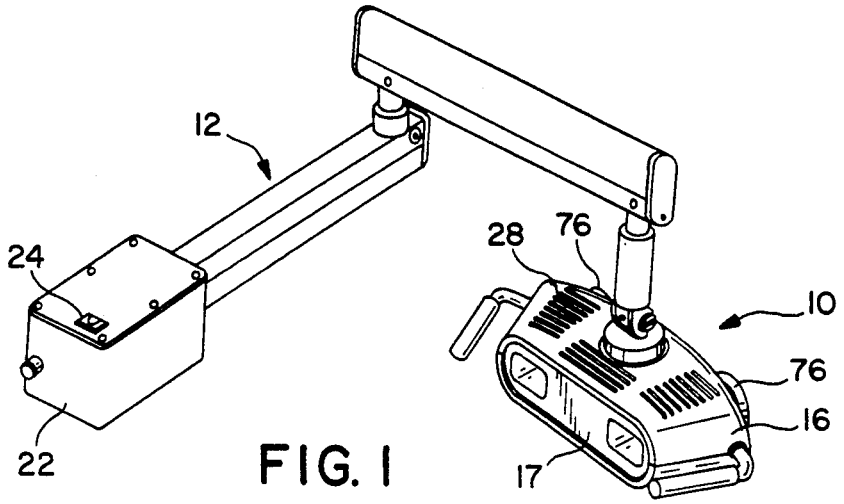
FIG. 1 is a perspective view of a dental operatory light depending from an adjustable arm and containing dual color-correcting optical delivery systems according to the invention.

Referring now to the drawings wherein like reference characters designate like or corresponding parts throughout the several views, there is illustrated in FIG. 1 a dental operatory light generally comprising a light head 10 pivotably supported by the outer end of a swivel arm assembly 12 which extends from a wall, ceiling or pedestal base. Handles 18 extending from either side of head 18 enable the use to adjust the position of the light source and its direction of illumination.

Figure 2:
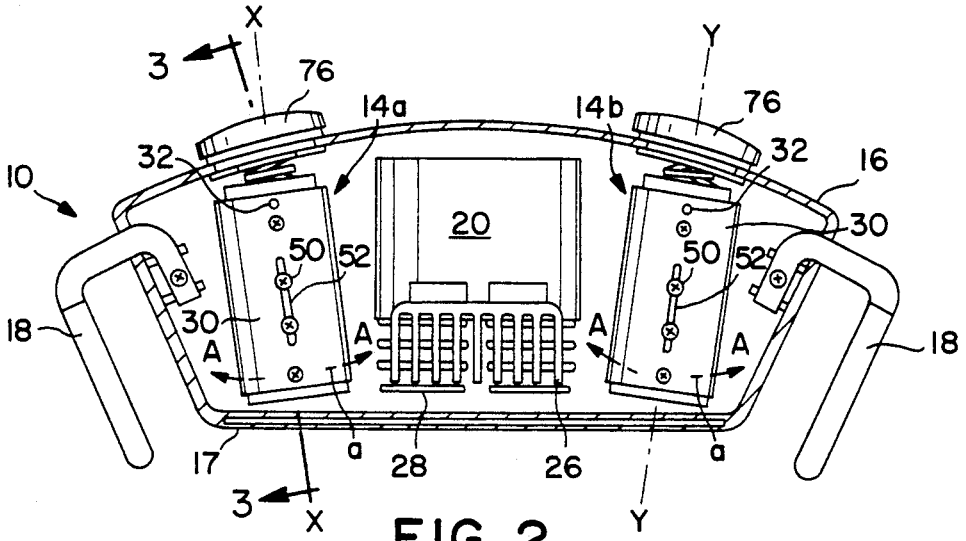
FIG. 2 is a view partially in lateral cross-section of the operatory light of FIG. 1.

As best illustrated in FIG. 2, light head 10 includes a pair of identical optical delivery systems 14*a* and 14*b* laterally spaced within opposite sides of a housing 16 on converging optical axes X—X and Y—Y, respectively, for directing light rays through transparent portions of a face plate 17. A printed circuit board 20 including an electric eye (not shown) on the lower side of board 20, is fixed to housing 16 between the optical systems, and is electrically connected between lamps 40 and a transformer 22 and a switch 24 located at the base end of arm assembly 12. In response to motion detected by the electric eye beneath light head 10, on-off power is provided to lamp 40. Heat generated in circuit board 20 is dissipated through a heat sink 26 affixed thereto next to ventilation slots 28 in the top and bottom of housing 16.

Figure 3:
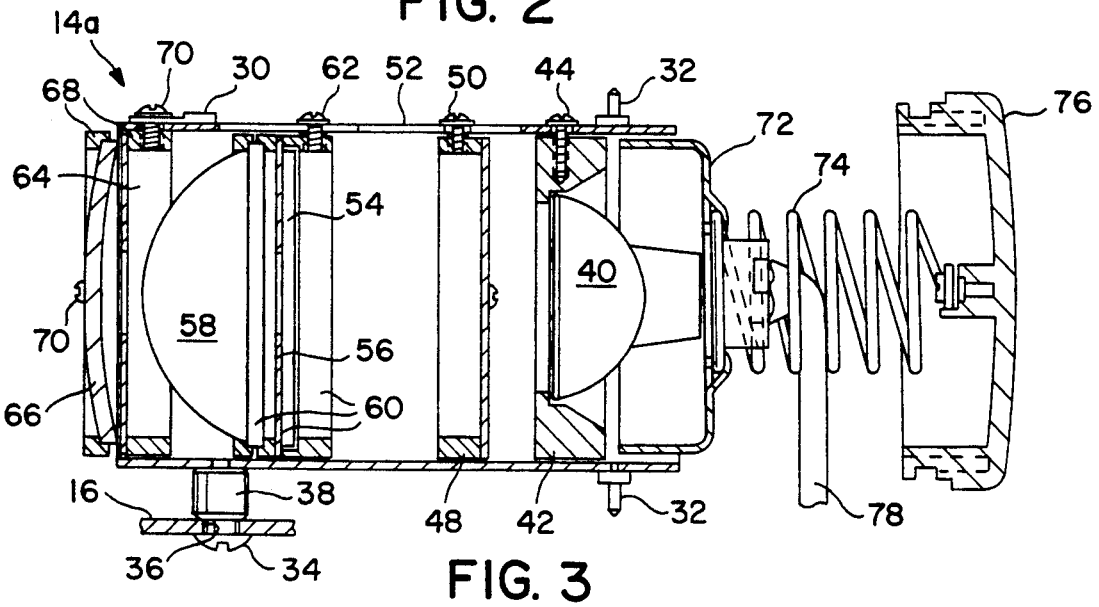
FIG. 3 is a view in longitudinal cross-section of an optical delivery system of FIG. 2 taken along the line 3—3 thereof.
Figure 4:
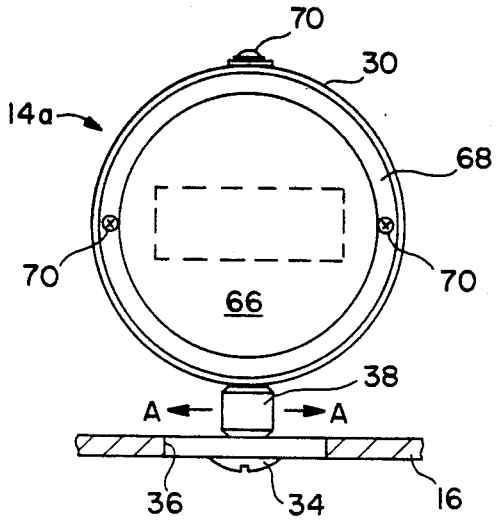
FIG. 4 is a front view of the system of FIG. 3.

Optical systems 14a and 14b include identical arrangements of optical elements mounted in axial alignment within light tubes 30. Referring to system 14a in FIGS. 3 and 4, diametrically opposite pivot pins 32 radially extend from the rear portion of light tube 30 and rotatably engage bearings (not shown) in the top and bottom of housing 16 to enable limited adjustment of the convergence angle of optical axes X—X and Y—Y, as shown by the arrows A—A. The adjusted angular position of the optical system is maintained by tightening a set screw 34 extending through a lateral slot 36 in the bottom of housing 16, into a spacer 38 affixed to the front portion of light tube 30.

Arranged within light tube 30 is a high-intensity, lamp 40 seated in a recess of an annular lamp holder 42 which is fixed to the rear portion of light tube 30 by a set screw 44. A suitable lamp is a tungsten-halogen type having an ellipsoidal reflector for emitting a light beam of about 2900° K color temperature.

Lamp 40 includes electrical terminals (not shown) insertable in a socket assembly 72 accessible through an opening in the back seal of housing 16. A compression spring 74 interposed between socket 72 and a knot 76 urges lamp 40 into the recess of holder 42, while knob 76 is secured by a bayonet-type interlock in the opening of housing 16. Socket 72 and circuit board 20 are electrically interconnected by insulated leads 78 for energizing lamp 40.

The light from lamp 40 is restricted by a first aperture stop 48 to a rectangular cross section. The axial position of stop 48 is fixed by tightening a set screw 50, extending through a longitudinal slot 52, into tube 30. The light beam is color-corrected to approximately 5,000° K to 6,000° K by a dual-function heat-reflective and wavelength-selective filter 54, then further restricted in rectangular cross section by second aperture stop 56, with the remaining through-put light collected by a single aspheric condenser lens 58.

Filter 54, stop 56 and lens 58 are maintained axially positioned relative to lamp 40 by annular retainers 60 and a set screw 62 extending through slot 52. The light beam from lens 58 then passes through a meniscus lens 66 and a third rectangular aperture stop 64, both being axially fixed in relation to aspheric lens 58 by annular retainer 68 and set screws 70.

Meniscus lens 56 is a concavo-convex surfaces designed to cancel the chromatic aberrations of aspheric lens 58. Meniscus lens 56 provides diffraction of the various wavelength paths equal and opposite to their diffraction by lens 58. All colors in the light beam therefore intersect at the same focal point and provides the proper mix of colors, i.e. blue, green and red, for color-correcting the light and results in white light illumination at a target area. It is understood, of course, that other types or numbers, optical lens arrangements are possible for eliminating the chromatic aberrations and light beam hue at the target. For example, the index of refraction and shape of one lens in an chromatic double may be arranged to cancel the chromatic aberrations of the other lens.

Figure 5:
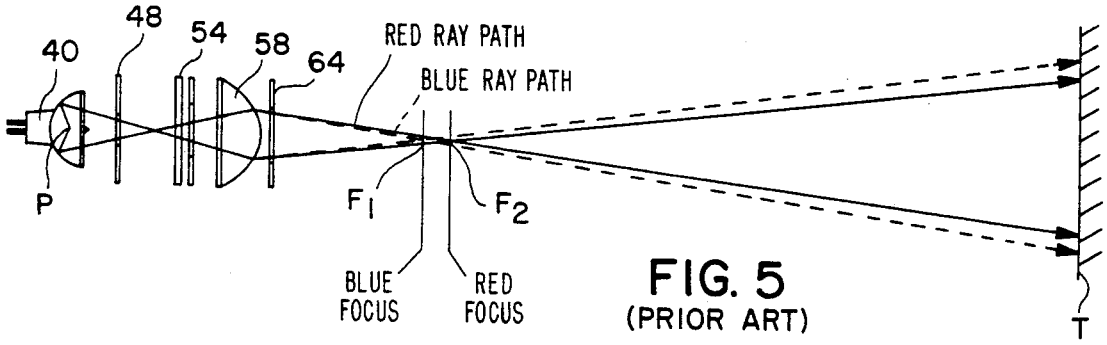
FIG. 5 (PRIOR ART)
FIG. 5 is a schematic diagram of a typical prior art optical delivery system illustrating light rays from a point source with uncorrected chromatic aberrations.
Figure 6:
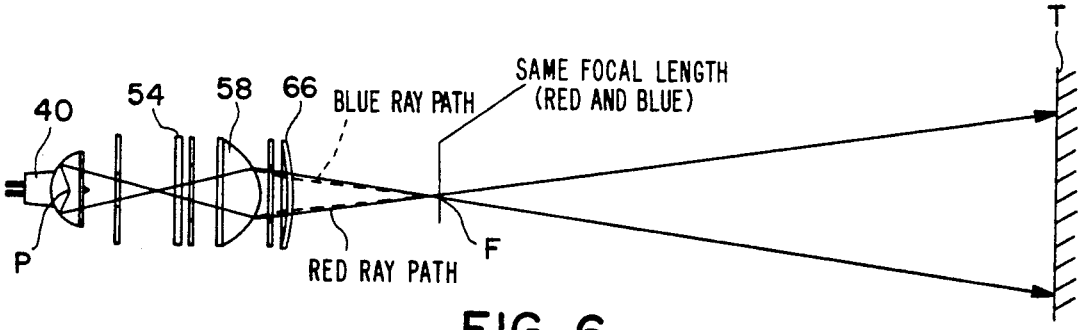
FIG. 6 is a schematic representation of the optical delivery system according to the invention illustrating light rays from a point source with correction for chromatic aberrations.

FIGS. 5 and 6 compare the effect of correcting chromatic aberrations in a color-corrected optical delivery system such as herein disclosed. In FIG. 5, reflected light at about 2900° K from a lamp filament P passes through aperture stop 48 and is heat-reflected and color-corrected by filter 54 to a correlated color temperature range of approximately 5,000° K to 6,000° K. After passing through optical stop 56 the light rays are collected as they pass through aspheric lens 58 and focus at different points $F_1$ and $F_2$ along the optical axis as a function of their wavelengths. The blue rays, being shorter in wavelength, they focus closer to lens 58 than the red rays. At the target T the blue and red rays are therefore separated and produce spectral lines resulting in a hue of some predominant color. In FIG. 6, meniscus lens 66 has been added to the same optical delivery system as in FIG. 5. Lens 66 corrects the wavelength defraction from lens 58 sufficient for the blue and red rays to meet at the same focal point F. Consequently, hue is completely eliminated at target T.

Some of the many advantages and novel features of the invention should be readily apparent. For example, a dental or medical operatory light is provided which includes optical delivery systems in which hue is substantially eliminated thereby making visual perception of shades of color on an illuminated target readily distinguishable to the naked eye. Each optical delivery system within a operatory light is complete unto itself. The light head is easy to maintain, and the lamps are readily replaceable.

It will be understood, of course, that various changes in the details, materials, steps and arrangement of parts, which have been herein described and illustrated in order to explain the nature of the invention, may be made by those skilled in the art within the principle and scope of the invention as expressed in the appended claims.

I claim:

1. An improved optical system for correcting chromatic aberrations in a dental/medical operatory light, the improvement comprising:

lamp means for emitting light of a color temperature less than that of white light in an optical path;

filter means positioned in said path for correcting the color temperature of the light to substantially that of white light;

first lens means positioned in said path for condensing light rays of different wavelengths of the light to their respective focal points; and second lens means positioned in said path for redirecting all of the light rays from said first lens an amount sufficient to intersect at a single focal point.

2. The improvement according to claim 1 wherein: said lamp means emits light of a color temperature less than about 5000° K; and said filter means corrects the color temperature to an approximate range between 5000° K and 6000° K.

3. The improvement according to Claim 1 wherein:

said lamp means includes a tungsten-halogen lamp emitting light with an approximate color temperature of 2900° K.

4. The improvement according to claim 1 wherein:

the color temperature is corrected between the approximate range of 5000° K and 6000° K with a color rendering index greater than 90.

5. The improvement according to claim 1 wherein:

said second lens means cancels chromatic aberrations produced by said first lens means.

6. The improvement according to claim 5 wherein:

said first lens means is an aspheric lens; and said second lens means is a meniscus lens.

7. A dental/medical operatory light comprising, in combination:

a source for generating a light beam along an optical axis;

color temperature correcting means intercepting the light beam for increasing the color temperature;

first lens means intercepting the light beam from said corrected means for condensing light rays of the light beam according to wavelength; and second lens means intercepting the light beam from said first lens means for diffracting the rays to a common focal point.

8. An operatory light according to claim 7 wherein:

said source radiates a color temperature less than that of white light; and said color temperature correcting means increases the color temperature to that of white light.

9. An operatory light according to claim 7 wherein:

said source comprises a tungsten-halogen lamp and an ellipsoidal reflector for producing the light beam with an approximate color temperature of 2900° K.

10. An operatory light according to claim 7 wherein:

said first lens means is an aspheric lens, and said second lens means is a meniscus lens.

11. A dental/medical operatory light comprising, in combination:

a light head housing adapted to be pivotally supported on the outer end of a swivel arm;

a pair of optical delivery systems mounted in spaced relation in said housing on converging optical axes, each of said systems including a lamp having a light output below a predetermined color temperature, an optical filter for increasing the color temperature to approximately white light, and lens means for diffracting the rays of various wavelengths of color to a common focal point.

* * * * *